US005967403A

United States Patent [19]

Kranz

[11] Patent Number: 5,967,403

[45] Date of Patent: Oct. 19, 1999

[54] REMAILABLE ENVELOPE AND METHOD FOR MAKING A REMAILABLE ENVELOPE FROM A SINGLE BLANK

[75] Inventor: Richard Kranz, Leawood, Kans.

[73] Assignee: Tension Envelope Corporation, Kansas City, Mo.

[21] Appl. No.: 09/108,654

[22] Filed: Jul. 1, 1998

[51] Int. Cl.[6] ..... B65D 27/10; B65D 27/06

[52] U.S. Cl. ..... 229/70; 229/69; 229/305

[58] Field of Search ..... 229/301, 305, 229/69, 70

[56] References Cited

U.S. PATENT DOCUMENTS

| | | | |
|---|---|---|---|
| 1,180,981 | 4/1916 | Cufal | 229/305 |
| 2,071,623 | 2/1937 | Giordano | 229/301 |
| 2,226,943 | 12/1940 | Poppe | 229/70 |
| 2,867,373 | 1/1959 | Kaufmann | 229/305 |
| 3,167,243 | 1/1965 | Wiley | 229/301 |
| 3,228,586 | 1/1966 | Hayes, Jr. | 229/305 |
| 3,229,893 | 1/1966 | Stein | 229/301 |
| 3,606,138 | 9/1971 | Allison | 229/70 |
| 3,817,445 | 6/1974 | Greason | 229/70 |
| 3,897,720 | 8/1975 | Hiersteiner . | |
| 3,946,938 | 3/1976 | Kranz . | |
| 3,995,808 | 12/1976 | Kehoe | 229/305 |
| 4,332,346 | 6/1982 | Kronman . | |
| 4,411,643 | 10/1983 | Higginson | 229/301 |
| 4,437,852 | 3/1984 | Volk, Jr. | 229/301 |
| 4,565,317 | 1/1986 | Kranz . | |
| 4,595,138 | 6/1986 | Kristel . | |
| 4,602,736 | 7/1986 | Barr . | |
| 4,715,531 | 12/1987 | Stewart et al. . | |
| 5,025,980 | 6/1991 | Blackman | 229/302 |
| 5,224,647 | 7/1993 | Yanow . | |
| 5,267,687 | 12/1993 | Sherman . | |
| 5,277,361 | 1/1994 | Stude . | |
| 5,400,957 | 3/1995 | Stude . | |
| 5,516,040 | 5/1996 | Lin . | |
| 5,738,274 | 4/1998 | Stude . | |

*Primary Examiner*—Stephen P. Garbe
*Attorney, Agent, or Firm*—Litman, Kraai & Brown L.L.C.

[57] ABSTRACT

A remailable envelope is formed from a single paper blank. The paper blank is first cut to yield a cut blank with an upper portion shaped as an originating legal sized envelope blank with a first back panel and a first front panel with a pair of side flaps and a seal flap attached thereto. The cut blank also includes a lower portion shaped as a return letter sized envelope blank with a second back panel and a second front panel with a seal flap attached to the second front panel. The first back panel and the second back panel are attached to each other. To form the envelope, the lower portion is first folded over the upper portion and the attached first and second back panels are simultaneously folded over and attached to the respective first and second front panels. This has the effect of placing the return envelope inside of the originating envelope.

8 Claims, 4 Drawing Sheets

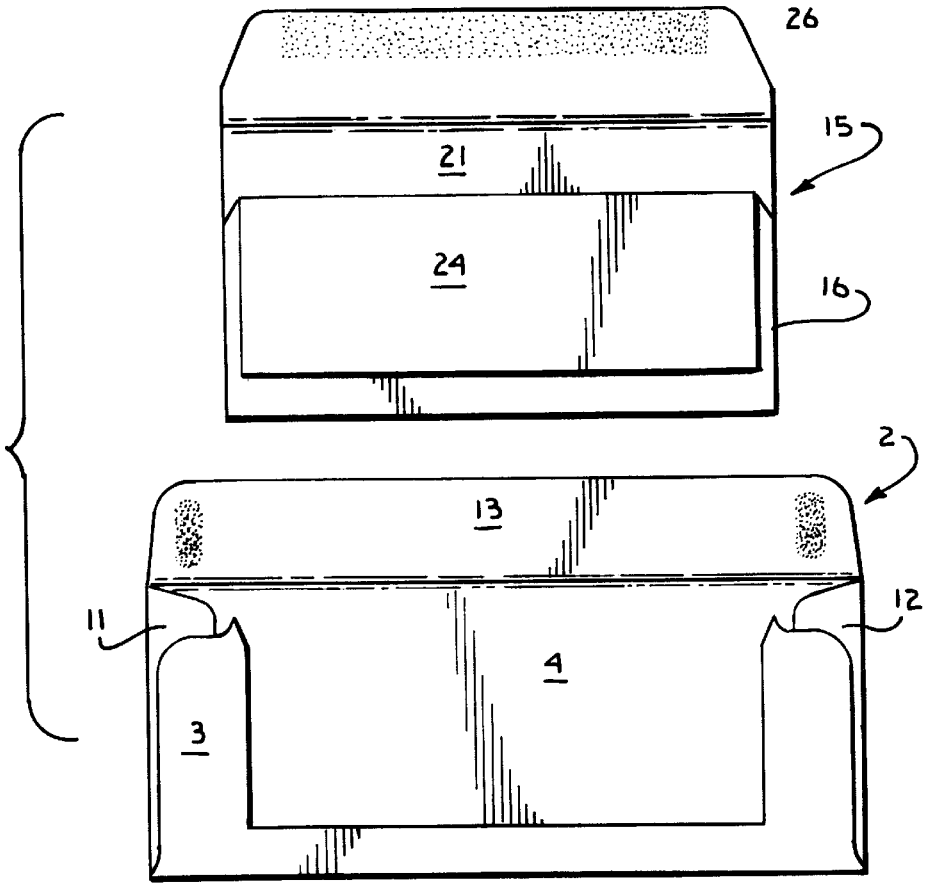
Fig. 5.
Fig. 3.
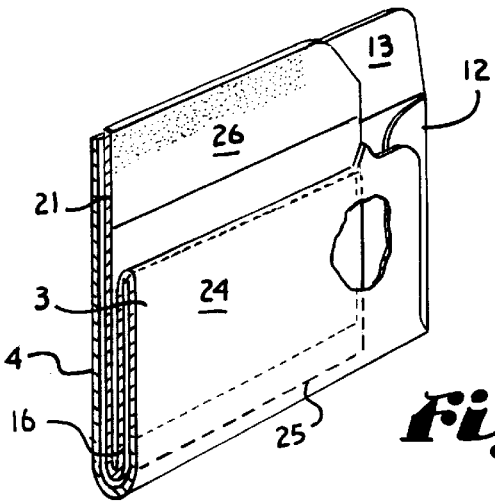
Fig. 2.
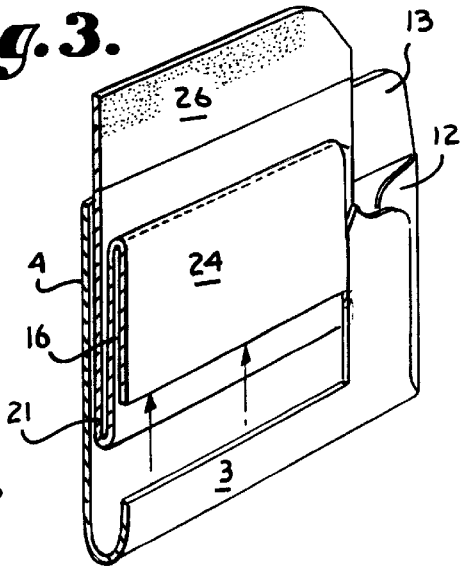

REMAILABLE ENVELOPE AND METHOD FOR MAKING A REMAILABLE ENVELOPE FROM A SINGLE BLANK

BACKGROUND OF THE INVENTION

1. Field of the Invention

This invention is directed to a remailable envelope for two-way mailing operations, and, more particularly, to such a remailable envelope which includes a first, originating envelope, a separable, remailing envelope, and a separable coupon or form, all made from a single paper blank.

2. Description of the Related Art

It has become standard practice in many businesses to send billing statements, advertisements and other solicitations, invitations, etc. along with preaddressed return envelopes. In order to cut costs with such mailings, a number of different "remailable" or "two-way" envelopes have been developed. These remailable envelopes typically incorporate both original and return addresses and require some type of manipulation by the original recipient to convert the envelope for remailing. This often involves relatively complex folding and/or separation of envelope portions to hide the originating address and reveal the return address. When multiple envelope pockets are included, often a portion of the originating pocket, e.g. the front panel, is used as a portion of the return pocket. This can result in a recipient tearing the envelope open and rendering it useless as a return mailer, thus defeating the purpose altogether.

In addition, typical remailable envelopes are fairly complex and expensive to manufacture, often requiring two or three separate paper sheets to be attached together. With modern Post Office mail handling and reading machinery and with large scale mail opening equipment used by commercial mailers, it is difficult to design a remailable envelope which meets the criteria of these machines.

One example of a prior art remailable envelope which attempts to address some of these problems is found in U.S. Pat. No. 5,267,687 to Richard Sherman and entitled Two Way Mailer. The Sherman remailable envelope is created from a single paper blank but it does have originating and return envelopes which utilize a common back panel. The return envelope is formed by directly adhering a rectangular front panel to the back panel via glue areas arrayed on either side of the back panel. The originating envelope is formed by separable side flaps which are adhesively attached to a separable originating front panel which itself includes a seal flap. An originating envelope is converted to a return envelope by removing the originating front panel and the side flaps to leave the return envelope. While the Sherman envelope design is made from a single paper blank, both originating and return envelopes still use a common back panel, thus contributing to potential problems in leaving the return envelope intact.

It is clear then, that a need exists for an improved remailable envelope design. Such a remailable envelope should preferably be made from a single paper blank, yet should include independent originating and return envelope pockets. The envelope should preferably have portions of the originating envelope, separate and separable from the return envelope, which can also be used as coupons or advertising material. Finally, such a remailable envelope should be compatible with existing postal and commercial mail handling equipment.

SUMMARY OF THE INVENTION

In the practice of the present invention, a remailable envelope is formed from a single paper blank. The paper blank is first cut to yield a cut blank with an upper portion shaped as an originating legal sized envelope blank with a first back panel and a first front panel with a pair of side flaps and a seal flap attached thereto. The cut blank also includes a lower portion shaped as a return letter sized envelope blank with a second back panel and a second front panel with a seal flap attached to the second front panel. The first back panel and the second back panel are attached to each other. The blank can be preprinted, either before or after cutting, with return addresses and other decorative and informational or promotional graphics and indicia.

The cut blanks are then run through a gluing and folding machine, which: places a rectangular pattern of scored lines of weakness on the first back panel; folds the lower portion over the upper portion; stacks the folded blanks in staggered position; places horizontal glue lines on the lower portion seal flaps; places fold lines between the respective seal flaps and their front panels and between the respective first front and rear panels and second front and rear panels; folds the side flaps inward over the first front flap; places vertical glue lines on either side of the inside surface of the second back panel, glue spots on the side flaps and on either edge of the upper portion seal flap; and simultaneously folds the first and second back panels over the respective first and second front panels, which forms the originating and return envelope pockets with the return envelope folded inside of the originating envelope.

OBJECTS AND ADVANTAGES OF THE INVENTION

The principal objects and advantages of the present invention include: to provide an improved remailable envelope constructed from a single paper blank; to provide such an envelope which reliably works in all Postal Service and commercial mail handling machinery; to provide such an envelope which includes attached but easily separable originating and return envelope pouches; to provide such an envelope in which the originating and return envelope pouches have their own front and back panels; to provide such an envelope in which a separable portion of the originating envelope back panel can be used as a coupon or return form, etc. which is sized for inserted into the return envelope pouch; to provide such an envelope which is economical to produce, yet is reliable for both originating and return mailing operations; and to provide such an envelope which is particularly well suited for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 2 is a cross-sectional view of the envelope of FIG. 1, taken along line 2—2 of FIG. 1, and with a portion of the originating envelope pouch back panel broken away to illustrate the spacial relationship between originating and return envelope pouches.

FIG. 3 is an additional cross-sectional view of the envelope of FIG. 1, again taken along line 2—2 of FIG. 1, but with the return envelope pouch and attached coupon severed from and being lifted away from the originating envelope pouch.

FIG. 5 is a rear elevational, exploded view showing a return envelope pouch and attached coupon separate from the originating envelope pouch.

DETAILED DESCRIPTION OF THE INVENTION

I. Introduction and Environment

Figure 1:
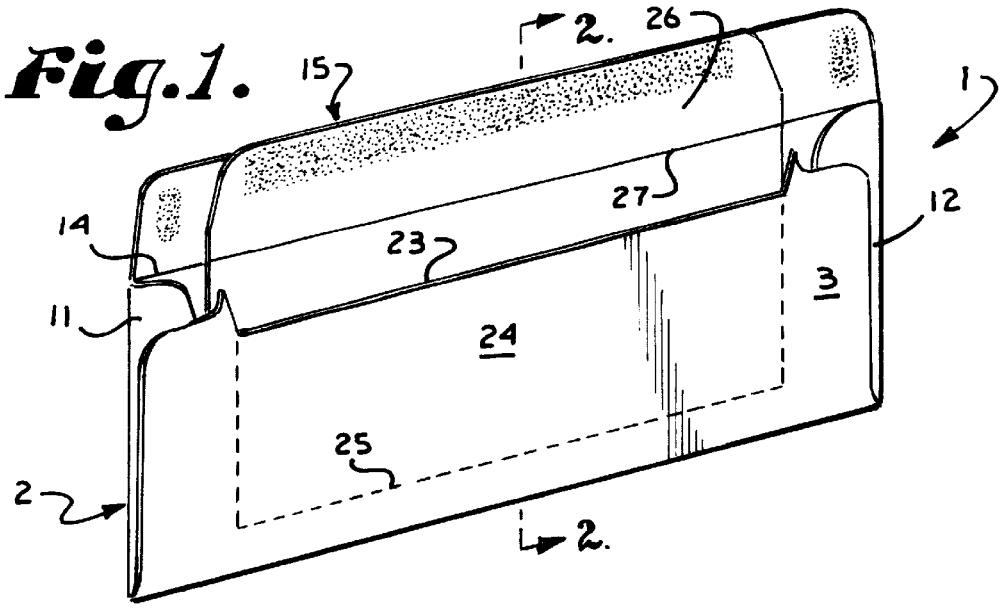
FIG. 1 is a perspective view of a remailable envelope according to the present invention.
Figure 4:
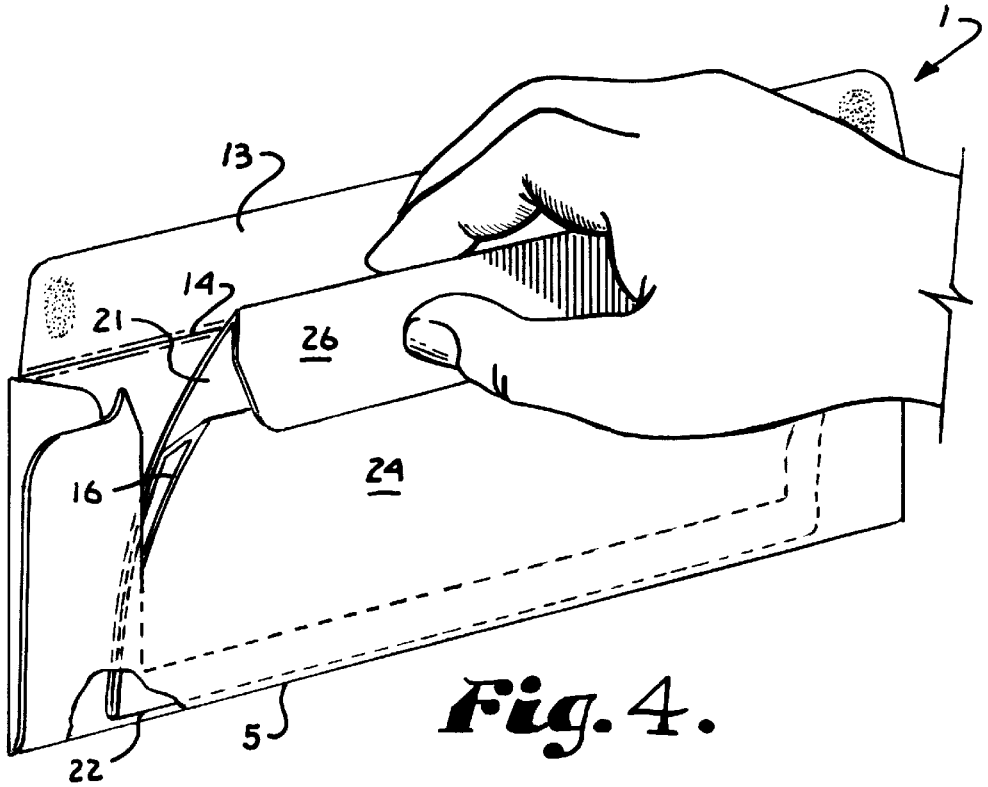
FIG. 4 is a perspective view of the envelope of FIG. 1 with the return envelope pouch and a return coupon being separated from the originating envelope pouch.
Figure 6:
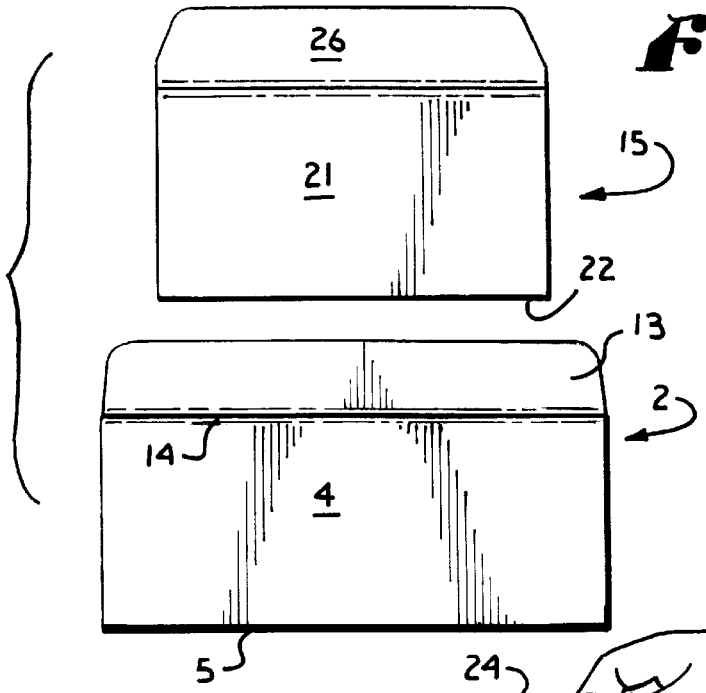
FIG. 6 is a front elevational, exploded view showing a return envelope pouch separate from the originating envelope pouch.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "up", "down", "right", and "left" will refer to directions in the drawings to which reference is made. The words "inward" and "outward" will refer to directions toward and away from, respectively, the geometric center of the embodiment being described and designated parts thereof. Said terminology will include the words specifically mentioned, derivatives thereof and words of a similar import.

II. Remailable Envelope

Referring to the drawings in more detail, FIGS. 1–8 illustrate a remailable envelope in accordance with the present invention, generally indicated at 1. The remailable envelope 1 includes an originating envelope pouch 2 formed via a back panel 3 and a front panel 4 attached together at a fold line 5. Attached to the front panel 3 are a pair of side panels 11 and 12 and a seal flap 13 attached by a fold line 14.

The remailable envelope 1 also includes an integral return envelope pouch 15 formed by a back panel 16 attached to a front panel 21 at a fold line 22. The return envelope pouch 15 is attached to the originating envelope pouch 2 at a fold line 23 between the return back panel 16 and the originating back panel 3. A separable coupon 24 is formed in the originating back panel 3 via a rectangular scored line of weakness 25. The scored line of weakness 25 also forms a mechanism for easily separating the return envelope pouch 15 from the originating envelope pouch 2. A return seal flap 26 is attached to the return front panel 21 at a fold line 27.

The originating envelope pouch 2 is formed by adhering the folded side flaps 11 and 12 to the originating back panel 3. The return envelope pouch 15 is formed by adhering the edges of the return back panel 16 to the outer edges of the return front panel 21.

Figure 7:
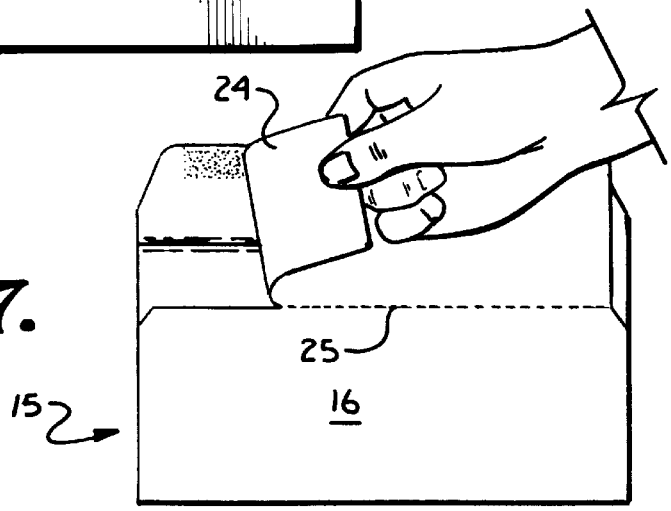
FIG. 7 is a rear elevational view of the separated return envelope with the attached coupon being separated therefrom.
Figure 8:
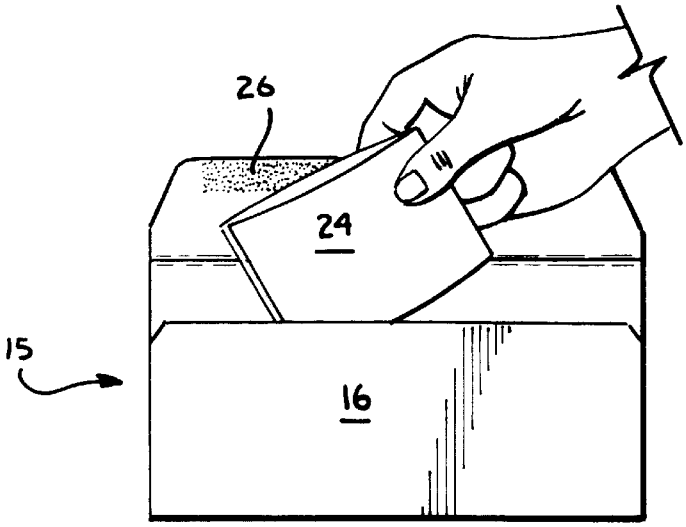
FIG. 8 is a rear elevational view of the separated return envelope with the separated coupon blank being inserted therein for return mailing.

FIGS. 1 and 2 illustrate the intact remailable envelope 1 with attached originating envelope pouch 2 and return envelope pouch 15. FIGS. 3–6 illustrate the return envelope pouch 15 being separated from the originating envelope pouch 2 by severing three sides of the rectangular scored line of weakness 25 surrounding the coupon 24 and lifting out the return envelope pouch 15 and coupon 24. FIG. 7 illustrates the coupon 24 being separated from the return envelope pouch back panel 16 by severing the remaining side of the rectangular scored line of weakness 25. FIG. 8 illustrates the coupon 24 being folded and inserted into the return envelope pouch 15 for mailing back to the sender or other preaddressed location.

III. Method of Making Remailable Envelope

Figure 9:
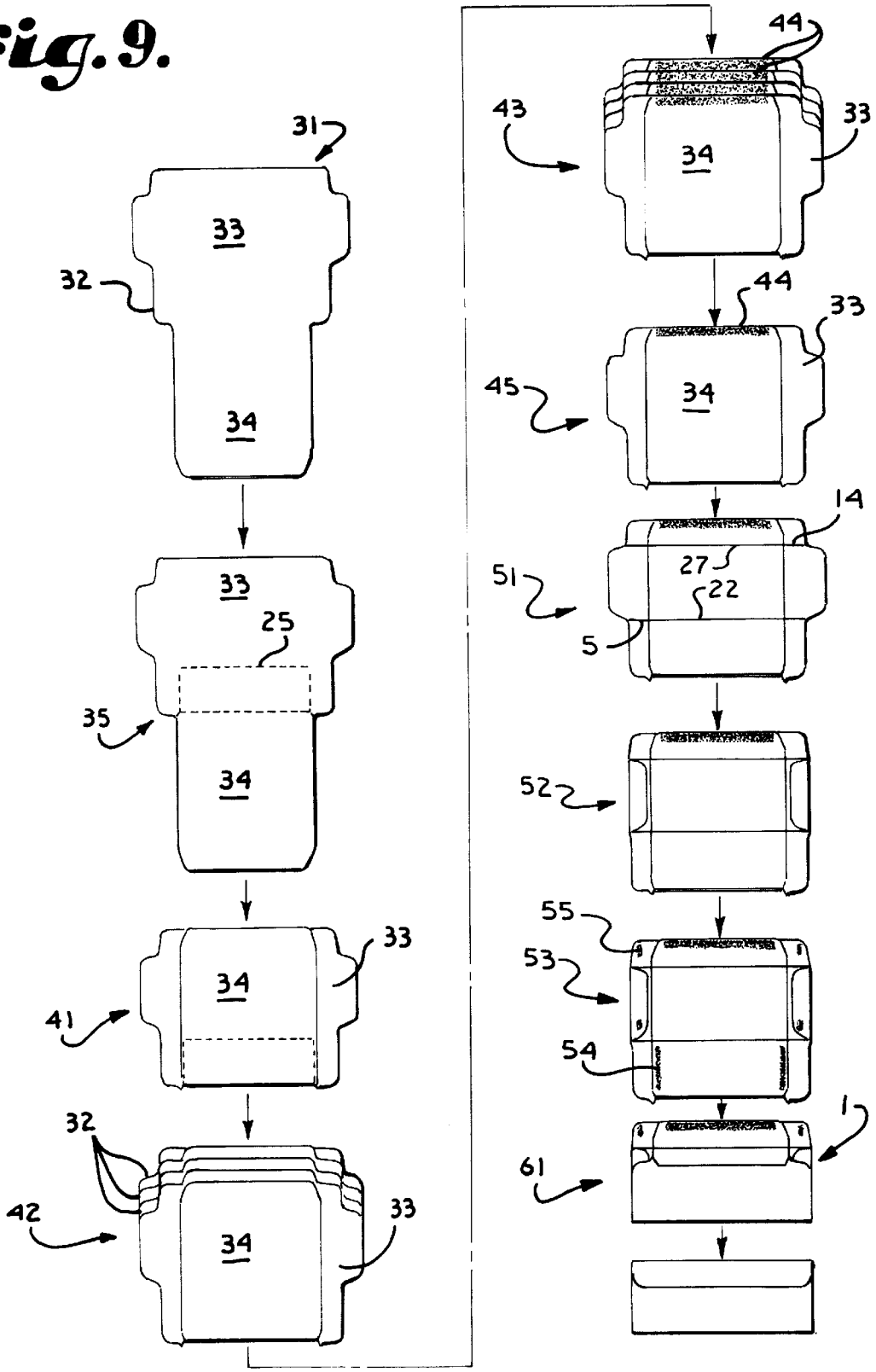
FIG. 9 is a sequential view illustrating the steps of creation and assembly required to produce the envelope of FIG. 1.

FIG. 9 illustrates the production steps used in producing the remailable envelope 1. At step 31, a single paper blank 32 is cut to the illustrated shape with an upper portion 33 shaped to from the originating envelope pouch 2 and a bottom portion 34 is shaped to form the return envelope pouch. At step 35, the rectangular scored line of weakness 25 is formed in the upper blank portion 33. At step 41, the lower blank portion 34 is folded over the upper portion 33 and, at step 42, the folded blanks 32 are stacked in a staggered configuration. At step 43, a horizontal glue strip 44 is placed on each of the stacked, lower blank portions 34. At step 45, the glued, stacked envelopes are separated, and, at step 51, the fold lines 14, 27 and 5, 22 are formed. At step 52, the side flaps 11 and 12 are folded inward over the originating envelope front panel 4, and, at step 53, vertical glue lines 54 are placed on either side of the inside surface of the return envelope back panel 16 and glue spots 55 are placed on the side flaps 11 and 12 and on either edge of the upper portion seal flap 13. At step 61, the originating and return envelope back panels 3 and 16, respectively, are folded over the originating and return envelope front panels 4 and 21, respectively, which adhere to each other to form the separable originating and return envelope pockets 2 and 15, respectively with the integral, separable coupon 24.

It is to be understood that while certain forms of the present invention have been illustrated and described herein, it is not to be limited to the specific forms or arrangement of parts described and shown.

I claim:

1. A remailable envelope, comprising:

a) an originating envelope pouch with originating back and front panels;

b) a return envelope pouch with return back and front panels, said return envelope pouch separably attached to said originating envelope pouch;

c) a coupon forming a portion of said originating envelope back panel, said coupon being defined by surrounding scored lines of weakness in said originating envelope back panel; and d) said originating envelope pouch is attached to said return envelope pouch via a portion of the surrounding scored lines of weakness defining said coupon.

2. A remailable envelope as in claim 1, wherein said return envelope back panel is attached to said originating envelope front panel via said portion of the surrounding scored lines of weakness defining said coupon.

3. A remailable envelope as in claim 1, wherein said originating and return envelope pouches are formed from a single blank.

4. A remailable envelope as in claim 1, wherein said originating envelope pouch is larger than said return envelope pouch such that said return envelope pouch can be folded inside of said originating envelope pouch.

5. A remailable envelope including:

a) an originating envelope pouch with a front panel and a back panel;

b) a return envelope pouch with a front panel and a back panel which are separate from said originating envelope front and back panels, respectively;

c) a coupon forming a portion of said originating envelope back panel, said coupon being defined by surrounding scored lines of weakness in said originating envelope back panel; wherein d) said originating envelope pouch is attached to said return envelope pouch via a portion of the surrounding scored lines of weakness defining said coupon, and said originating and return envelope pouches are created from a single blank.

6. A remailable envelope as in claim 5, wherein:

a) said originating envelope back panel is attached to said return envelope back panel via a portion of the surrounding scored lines of weakness defining said coupon.

7. A remailable envelope made from a single continuous blank, including:

a) a first portion of said blank including a first back panel attached to a first front panel at a first fold line with a first seal flap attached to said first front panel;

b) a pair of side flaps with one attached to each respective side of said first front panel;

c) a second portion of said blank including a second back panel attached to a second front panel at a second fold line with a second seal flap attached to said second front panel, said second back and front panels being narrower than said first back and front panels, respectively, said first back panel and said second back panel being attached to each other at a score line;

d) said second portion of said blank being folded over said first portion at the attachment of said first and second back panels at said score line such that said first and second fold line coincide with each other;

e) said first back panel being folded over said first front panel at said first fold line and adhesively secured to said side flaps; and f) said second back panel being folded over said second front panel at said second fold line and adhesively secured thereto.

8. A remailable envelope as in claim 7, and further comprising:

a) a separable coupon formed in said first back panel by an outline of scored lines of weakness in said first back panel, a portion of said scored lines of weakness coinciding with said score line between said first and second back panels.

* * * * *